US007980744B2

(12) United States Patent
Wang

(10) Patent No.: US 7,980,744 B2
(45) Date of Patent: Jul. 19, 2011

(54) FORMED LIGHTING FIXTURE HAVING A FIBROUS LAYER

(76) Inventor: Jessica Wang, Taipei (TW)

( * ) Notice: Subject to any disclaimer, the term of this patent is extended or adjusted under 35 U.S.C. 154(b) by 5 days.

(21) Appl. No.: 12/703,584

(22) Filed: Feb. 10, 2010

(65) Prior Publication Data

US 2010/0202156 A1 Aug. 12, 2010

Related U.S. Application Data

(63) Continuation of application No. 12/235,451, filed on Sep. 22, 2008, now Pat. No. 7,682,060, which is a continuation of application No. 11/644,988, filed on Dec. 22, 2006, now Pat. No. 7,661,847.

(51) Int. Cl.
*F21S 13/14* (2006.01)

(52) U.S. Cl. ..... 362/565; 362/556; 362/124; 362/806; 362/249.14

(58) Field of Classification Search ..... 362/565, 362/556, 124, 249.19, 252, 806
See application file for complete search history.

(56) References Cited

U.S. PATENT DOCUMENTS

| | | | | |
|---|---|---|---|---|
| 1,589,018 | A | | 6/1926 | Ludwig |
| 1,684,922 | A | | 9/1928 | Mammen |
| 1,902,991 | A | | 3/1933 | Cardon |
| 2,173,032 | A | | 9/1939 | Wintermute |
| 2,174,328 | A | | 9/1939 | Meston et al. |
| 2,191,041 | A | | 2/1940 | Protz |
| 3,400,263 | A | | 9/1968 | Yakim |
| 3,694,648 | A | | 9/1972 | Yates |
| 4,060,722 | A | * | 11/1977 | Foley ..... 362/568 |
| 4,219,870 | A | | 8/1980 | Haraden et al. |
| 4,228,486 | A | | 10/1980 | Matsuya |
| 4,339,787 | A | | 7/1982 | Burnbaum |
| 4,364,102 | A | | 12/1982 | Huppert et al. |
| 4,462,065 | A | | 7/1984 | Rhodes |
| 4,519,017 | A | | 5/1985 | Daniel |
| 4,713,586 | A | | 12/1987 | Chiang |
| 4,757,099 | A | | 7/1988 | Hoshino et al. |
| 4,803,396 | A | | 2/1989 | Kelner |
| 4,879,969 | A | | 11/1989 | Haranoya et al. |

(Continued)

FOREIGN PATENT DOCUMENTS

CN 2475920 2/2002

(Continued)

OTHER PUBLICATIONS

Longwood Gardens—Seasonal Festivals—2000 Christmas, URL=http://www.longwoodgardens.org/SeasonalFestivals/Christmas/2000christmas.htm, download date Nov. 23, 2000.

(Continued)

*Primary Examiner* — Anabel Ton
(74) *Attorney, Agent, or Firm* — Seed IP Law Group PLLC

(57) ABSTRACT

An improved formed lighting fixture having a frame, a light source, a cover layer coupled to the frame, and a fibrous layer coupled to the cover layer, in which the frame is formed by gathering a plurality of rods and profiled in a specific contour, the light source is configured to provide light from inside the frame and out through the cover layer onto the fibrous layer. The fibrous layer is configured to provide decorative and functional aspects to the lighting fixture, including, in some embodiments, a contoured or fur-like appearance, or where the fibrous layer has light-diffusive properties, a dazzling glow effect when light from the light source is diffused.

21 Claims, 7 Drawing Sheets

U.S. PATENT DOCUMENTS

| | | | | |
|---|---|---|---|---|
| 4,905,627 | A | | 3/1990 | Yoshikawa |
| 4,992,914 | A | | 2/1991 | Heiss et al. |
| 5,001,615 | A | | 3/1991 | Stefanelli |
| 5,021,928 | A | | 6/1991 | Daniel |
| 5,104,608 | A | | 4/1992 | Pickering |
| 5,108,777 | A | | 4/1992 | Laird |
| 5,150,964 | A | | 9/1992 | Tsui |
| 5,183,323 | A | | 2/1993 | Daniel |
| 5,233,680 | A | | 8/1993 | Fussell |
| 5,250,331 | A | | 10/1993 | Grefalda |
| 5,331,529 | A | | 7/1994 | Huang |
| 5,367,443 | A | | 11/1994 | Hara |
| 5,379,202 | A | | 1/1995 | Duan |
| 5,394,315 | A | | 2/1995 | Ahroni |
| 5,396,408 | A | | 3/1995 | Szczech, III |
| 5,498,922 | A | | 3/1996 | Chang |
| 5,517,390 | A | | 5/1996 | Zins |
| 5,566,483 | A | | 10/1996 | Ogren |
| 5,580,159 | A | | 12/1996 | Liu |
| 5,626,415 | A | | 5/1997 | Huang |
| 5,645,343 | A | | 7/1997 | Rinehimer |
| 5,772,312 | A | | 6/1998 | Pihl-Niederman et al. |
| 5,816,686 | A | | 10/1998 | Wang et al. |
| 5,828,183 | A | | 10/1998 | Wang et al. |
| 5,850,927 | A | | 12/1998 | Pan |
| 5,861,128 | A | | 1/1999 | Vick et al. |
| 5,915,827 | A | | 6/1999 | Wang |
| 5,955,156 | A | | 9/1999 | Hermanson |
| 5,969,469 | A | | 10/1999 | Wang |
| 6,001,435 | A | * | 12/1999 | Hardy et al. ..... 428/18 |
| 6,164,793 | A | | 12/2000 | Wu |
| 6,180,193 | B1 | | 1/2001 | Bostedt |
| 6,258,871 | B1 | | 7/2001 | Brown, III |
| 6,284,330 | B1 | | 9/2001 | Hermanson |
| 6,329,028 | B1 | | 12/2001 | Bucher |
| 6,334,974 | B1 | | 1/2002 | Chen |
| 6,394,282 | B1 | | 5/2002 | Pan |
| 6,413,594 | B1 | | 7/2002 | Onishi |
| 6,478,164 | B1 | | 11/2002 | Pan |
| 6,566,416 | B2 | | 5/2003 | Brown, III |
| 6,652,927 | B1 | | 11/2003 | Chen |
| 6,682,208 | B1 | | 1/2004 | Pan |
| 6,719,440 | B1 | | 4/2004 | Wang |
| 6,769,954 | B2 | | 8/2004 | Su |
| 6,830,361 | B2 | | 12/2004 | Wang |
| 6,854,863 | B2 | | 2/2005 | Wu |
| 6,905,229 | B2 | * | 6/2005 | Fan ..... 362/235 |
| 7,086,757 | B2 | * | 8/2006 | Wang ..... 362/249.01 |
| 7,234,853 | B2 | * | 6/2007 | Givoletti ..... 362/556 |
| 7,303,312 | B2 | * | 12/2007 | Wang ..... 362/249.16 |
| 7,682,060 | B2 | * | 3/2010 | Wang ..... 362/565 |
| 2002/0121295 | A1 | | 9/2002 | Chen et al. |
| 2003/0156405 | A1 | | 8/2003 | Kim |
| 2003/0184829 | A1 | | 10/2003 | Odhner et al. |
| 2003/0214809 | A1 | | 11/2003 | Wong |
| 2004/0100797 | A1 | | 5/2004 | Yang |
| 2004/0125594 | A1 | | 7/2004 | Wu |
| 2005/0105288 | A1 | | 5/2005 | Chen |
| 2006/0147353 | A1 | | 7/2006 | Wang |
| 2006/0158888 | A1 | | 7/2006 | Wang |
| 2006/0274526 | A1 | | 12/2006 | Weston et al. |

FOREIGN PATENT DOCUMENTS

| | | |
|---|---|---|
| CN | 02272047.2 | 10/2003 |

OTHER PUBLICATIONS

ChristmasDepot.com—Outdoor Decorations Topiary Sculptures Menu, URL=http://web. archive.org/web/20020117044252/www.christmaspromotions.com/menu.cgi?S=Outdo..., archived as of Jan. 17, 2002.

ChristmasDepot.com—Christmas—Outdoor Decorations—Topiary Sculptures Standing Deer—3 . . . , URL=http://web.archive.org/web/20020118074543/www.christmaspromotions.com/prod.cgi?6904, archived as of Jan. 18, 2002.

ChristmasLights, Etc.-christmas lights, pre-lit artificial christmas trees, outdoor decorations, URL=http://web.archive.org/web/20020121032518/http://www.christmaslightsetc.com/, archived as of Jan. 21, 2002.

Christmas Holiday Decorations by Brite Star, URL=http://web.archive.org/web/20010708003923/www.britestar.com/products.ASP?PID=1620&SID=..., archived as of Jul. 8, 2001.

Photographs taken on Nov. 16, 2005, Magicolor 100 Light String Set, Magicolor, Inc., Arlington, Texas, first sold Apr. 13, 2001.

Everstar Merchandise Co., Ltd., Garden Ridge Quote Sheet and Photos, dated Nov. 15, 2005, 3 pages.

* cited by examiner

FORMED LIGHTING FIXTURE HAVING A FIBROUS LAYER

CROSS-REFERENCE TO RELATED APPLICATIONS

This application is a continuation of U.S. patent application Ser. No. 12/235,451, filed Sep. 22, 2008, now pending, which is a continuation of U.S. patent application Ser. No. 11/644,988, filed Dec. 22, 2006, now pending, which applications are incorporated herein by reference in their entireties.

FIELD OF THE INVENTION

This invention relates generally to formed lighting fixtures, and more particularly, it relates to an improved formed lighting fixture having a fibrous layer that creates an appearance of fur or diffuses light creating a glowing effect at night.

BACKGROUND OF THE INVENTION

In order to heighten a festive atmosphere, formed lighting fixtures made in specific shapes can be displayed. Embodiments of various formed light fixtures are described in U.S. Pat. No. 7,086,757, incorporated herein by reference in its entirety.

Referring to FIG. 1, one embodiment of a conventional formed lighting fixture A is constructed with a frame 1 and a light source 2, in which the frame 1 can have a specific appearance and be comprised of a plurality of rods, while the light source 2 is a plurality of light bulbs that are spaced apart about the entire skeleton such that the frame 1 could serve as a lighting ornament. The frame 1 is also coated with a layer of cover material 3. In some embodiments of the prior art, the cover material 3 is a transparent refracting material that refracts the light emanating from the light source 2.

In the conventional formed lighting fixture A, the cover material 3 is a substantially flat layer that does not have a dimension of material extending outward from the surface of the cover material 3. Without the added dimension of material of the present invention, certain functional and decorative aspects of the lighting fixture are not present. For example, added dimensions of material on the outer surface of the lighting fixture A would allow refraction of light passing through the cover material 3, and would allow further decorative options to enhance the appearance of the formed lighting fixture A. Moreover, the added dimension of material may be electrostatically flocked to the cover material 3 in accordance with embodiments of the present invention. There are a variety of electrostatic flocking methods and devices available, such as those described in U.S. Pat. Nos. 2,173,032, 2,174,328, 4,879,969, 4,905,627 and 5,108,777, all of which are incorporated herein by reference in their entirety.

SUMMARY OF THE INVENTION

An improved formed lighting fixture is described providing a dimension of material, referred to in embodiments as a fibrous layer, extending away from an outer surface of the formed lighting fixture. In embodiments, the fibrous layer is configured to provide certain functional and decorative characteristics to the formed lighting fixture, such as providing a textured, colored, or fur-like appearance, or light-diffusion. In some embodiments where the fibrous layer diffuses light, a glowing effect is provided, especially visible at night, when the light passing through the outer surface of the formed lighting fixture is diffused throughout portions of the fibrous layer.

In embodiments, the fibrous layer comprises a plurality of fibers adhered to the outer surface of the formed lighting fixture. In embodiments, the plurality of fibers are electrostatically flocked to the outer surface of the formed lighting fixture. In some embodiments, the outer surface of the formed lighting fixture is a refracting layer, a mesh, a layer of fabric, or some other substrate that allows at least a portion of the light to pass therethrough.

In embodiments, the structure of the formed lighting fixture is constructed with a frame, a light source, and a cover layer, in which the frame can be formed by gathering a plurality of rods and profiled in a specific contour (e.g., a Christmas tree, a Santa Claus, or a deer, etc.). The light source can be a plurality of light bulbs installed on, coupled to or otherwise spaced about the frame to serve as lighting ornaments. The frame can be coated with the cover layer. In some embodiments, the cover layer comprises a refractive portion, the refractive portion comprising a layer of transparent refracting material. In embodiments, the refracting material comprises plastic, acrylic, PVC, or glass or another vitreous material.

In an embodiment, a decorative lighting fixture is provided, the fixture comprising a frame having structural elements adapted to form a desired contoured shape; a light source; a substrate coupled to the frame, wherein the light source is configured to provide light from inside the frame and through at least a portion of the substrate; and a fibrous material coupled to at least a portion of the substrate such that at least some of the light provided through the substrate can be diffused by the fibrous material.

In another embodiment, a method for making a lighting fixture having a fur-like appearance is provided, the method comprising: providing a cover layer; providing an adhesive layer over at least a portion of the cover layer; providing an electric field proximate at least a portion of the cover layer having the adhesive layer; providing an electrically charged fibrous material proximate the electric field such that at least a portion of the electrically charged fibrous material is drawn towards at least the portion of the cover layer having the adhesive layer; forming a frame in a contoured shape; coupling a light source to the frame; and distributing the cover layer over at least a portion of the frame. In embodiments, the cover layer may be distributed over at least a portion of the frame prior to providing the electric field proximate at least a portion of the cover layer having the adhesive layer, or prior to providing the electrically charged fibrous material proximate the electric field such that at least a portion of the electrically charged fibrous material is drawn towards at least the portion of the cover layer having the adhesive layer.

In yet another embodiment, a decorative holiday lighting fixture is provided, the fixture comprising: a means for creating a desired shape wherein the desired shape comprises a contoured holiday decoration; a means for providing light within at least a portion of the desired shape; a means for covering at least a portion of the desired shape and allowing at least some of the light to escape therefrom; and a means for providing an enhanced appearance coupled to at least a portion of the covering means, wherein the enhanced appearance comprises a fur-like appearance. In embodiments, the means for creating a desired shape comprises a frame having structural elements adapted to form the desired contoured holiday decoration; the means for providing light comprises a light source coupled to the frame; the covering means comprises a cover layer coupled to the frame; and the means for providing an enhanced appearance comprises fibrous material coupled to an adhesive layer on at least a portion of the cover layer. Moreover, in an embodiment, at least a portion of the fibrous material is coupled to the adhesive layer by a means for creating a layer of fibrous material, wherein the means for creating a layer of fibrous material comprises electrostatic flocking.

Some advantages and features of embodiments could be summarized as follows: by adding the fibrous layer to a portion of the outer surface of the formed lighting fixture, light from the light source passing through the cover layer may be diffused by the fibrous layer, producing a dazzling effect and a glowing appearance especially visible at night; the fibrous layer may also contribute a decorative texture and visual appeal, wherein in some embodiments, a fur-like appearance is created; and many other benefits may be achieved by adding the fibrous layer, where the benefits may include, depending on characteristics of a material comprising the fibrous layer, increased weather durability, rich colors or pastel shades, iridescence, high sheen, coarse effects, sculptured surface, and other special effects for the outer surface of the light fixture. More detailed information regarding embodiments is described below with reference to the enclosed drawings.

BRIEF DESCRIPTION OF THE DRAWINGS

The drawings discussed in the detailed description of this invention are described briefly as follows, in which.

DETAILED DESCRIPTION OF THE INVENTION

The detailed description of some embodiments is made below with reference to the enclosed drawings.

Figure 1:
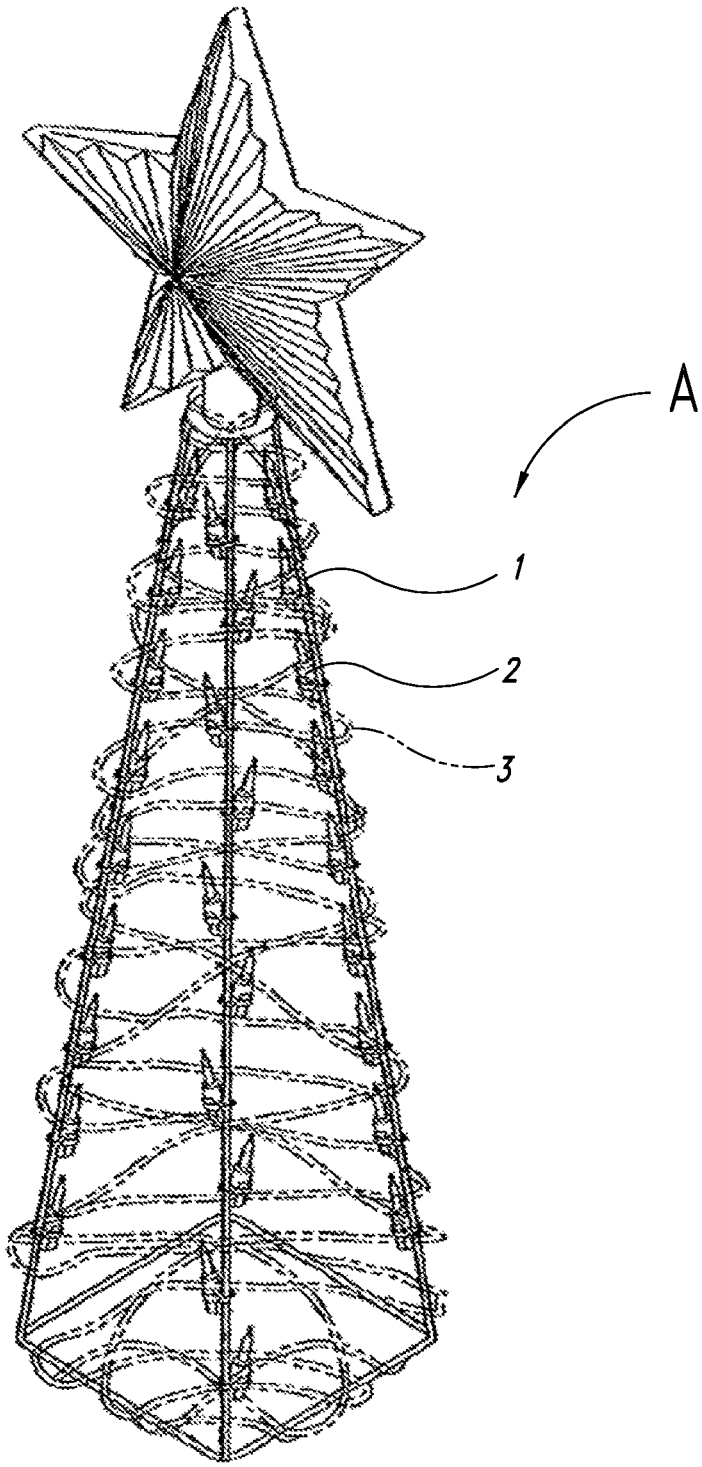
FIG. 1 (Prior Art)
FIG. 1 is a perspective view of a conventional formed lighting fixture, according to the prior art.
Figure 2:
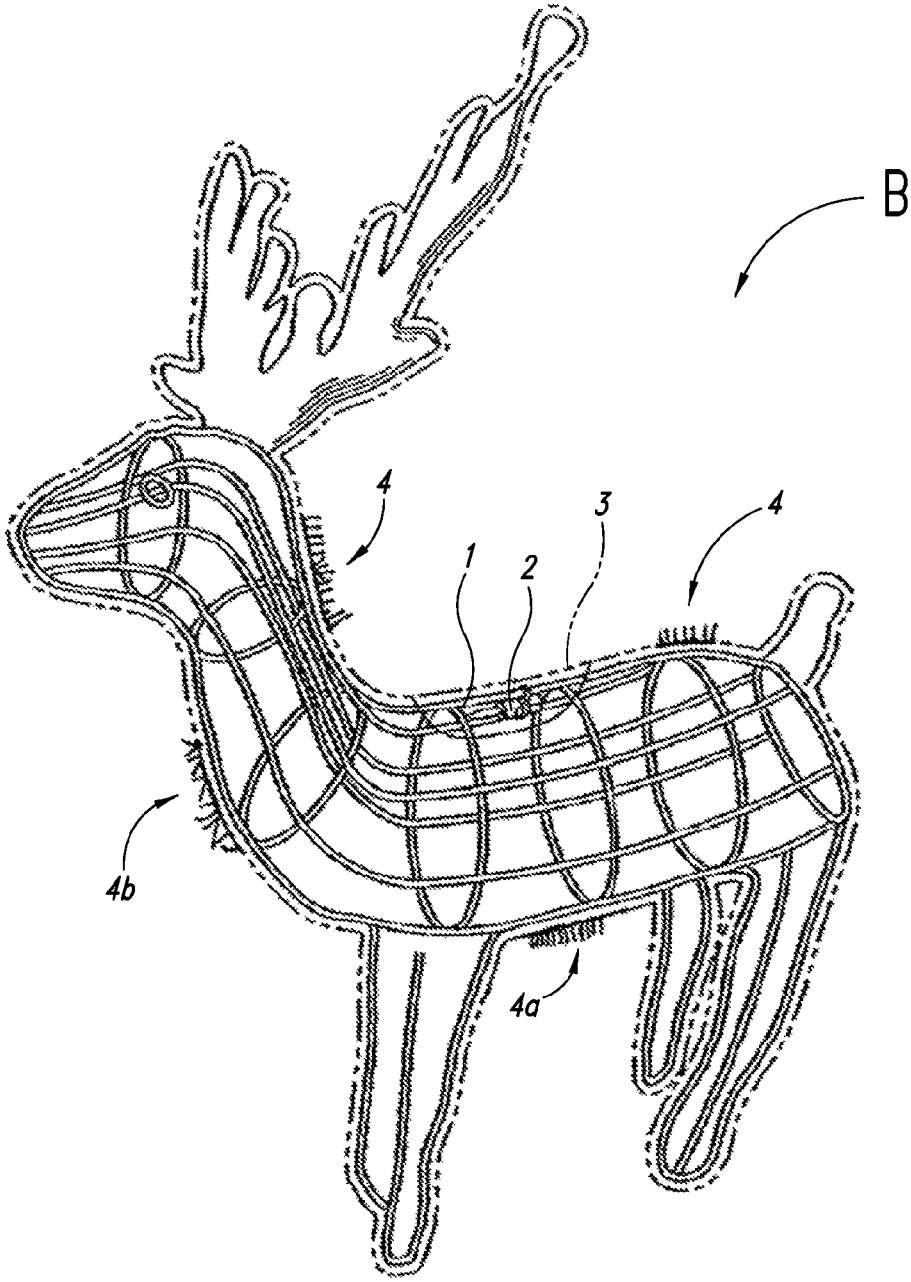
FIG. 2 is a perspective view of a formed lighting fixture, depicted as a deer, comprising a fibrous layer.
Figure 3:
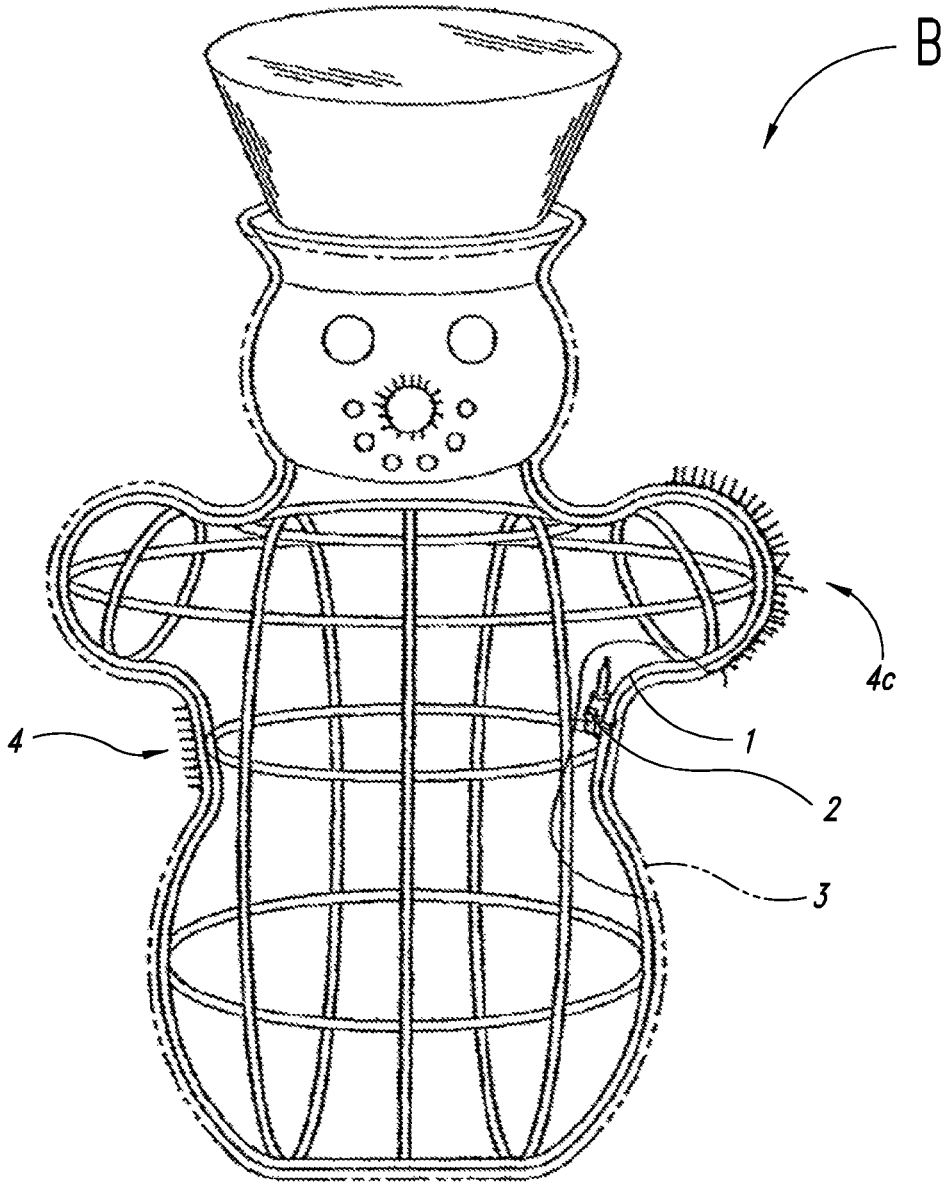
FIG. 3 is a perspective view of the lighting fixture, depicted as a snowman, comprising a fibrous layer.

Referring to FIGS. 2 and 3, in embodiments, a formed lighting fixture B comprises a frame 1, a light source 2, a cover layer 3, and a fibrous layer 4.

The frame 1 illustrated in FIGS. 2 and 3 is a skeleton made by aggregating a plurality of rods. A means for creating a desired shape comprises the frame. In embodiments, the frame 1 is configured to resemble a seasonable and timely formation, such as a Christmas tree, a snowman, or a deer, etc. The frame 1 may be made with rod or rib material, such as metal, plastic, wood, wicker, fiberglass, or polymer material. Each of the rods or ribs may be slender, cylindrical and lightweight. The rods or ribs may then be formed into the desired shape and held together by connectors on their ends or held together by other ways, such as welds, glue, or ties. As such, depending on how the rods or ribs are formed and connected, portions of the frame 1 may be contoured, substantially planar, or combinations of both. The frame 1 may also have tapered ends with increasing dimensions therebetween The light source 2 serves as the fixture's B light source. A means for providing light comprises the light source. Although FIGS. 2 and 3 depict only one light bulb 2 disposed on the skeleton of the frame 1, many other configurations are possible. For example, the light source 2 may comprise a plurality of light bulbs or LEDs disposed on the skeleton of the frame, or the fixture B may have a single or multiple light sources 2 disposed in the hollow portion of the frame 1. Other embodiments have a string of lights wrapped around or attached to the frame 1, and yet more embodiments have a plurality of light tubes that may be tangled on or along the frame 1 or made part of the frame 1.

The cover layer 3 is represented by centerlines for clarity. A means for covering a means for creating a desired shape comprises the cover layer. The cover layer 3 may be any material having a desired durablity, rigidity, and flexiblity to form a cover for the lighting fixture B, including but not limited to textile fabrics, non-woven substances, cloth, plastic, polystyrene, paper, glass, leather, vinyl, rubber, flexible or rigid foam, PVC, acrylic, polyester, nylon, silk, Mylar, metal, or cellophane. The cover layer 3 may be a contiguous piece of material, or it may comprise individual sections that can be sewn, melted, taped or glued together to form the cover layer 3. In embodiments, the cover material is a transparent or translucent fabric or a material that refracts light such as a transparent vitreous material, or a plastic material such as PVC or acrylic. In other embodiments, the cover material 3 may be opaque with a plurality of holes punched therein to permit at least a small portion of light to escape the fixture B. In other embodiments, the cover layer 3 is a screen or mesh of material. The cover layer 3 may also be a combination of materials, as long as at least portion of the cover layer 3 allows at least some light from the light source 2 to escape the fixture B.

The cover layer 3 is coupled to the frame 2. In embodiments, the cover layer 3 is a flexible material that is stretched between two or more rods or ribs of the frame 1 and is securely adhered to the frame 1 in various locations. For example, edge portions of the cover layer 3 may be glued or otherwise attached to the frame 1, and areas of the cover layer 3 between the edge portions may also be attached to the frame 1. The cover layer 3 may cover a portion of or the entire frame 1.

In some embodiments, the cover layer 3 is configured to provide decorative and functional aspects to the lighting fixture B for a more colorful or attractive scene. For example, where the cover layer 3 is a refractive material, a dazzling phenomenon is created when light emitted from the light source 2 penetrates into and refracted through the cover layer 3, making the lighting fixture B appear more splendid and elegant. In embodiments, the cover layer 3 is tinted, colored, or patterned. For example, as depicted in FIG. 3, if the fixture B is substantially formed into the shape of a snowman, a section of the cover layer 3 at the hands of the snowman may be tinted or patterned to appear glove-like, such as with black tint or coloring, or a section of the cover layer 3 at a nose of the snowman may be tinted or pattered to appear carrot-like, such as with orange tint or coloring. Further, a specific pattern of colors, for example an ornament on a Christmas tree, a Santa Claus costume, or the stripe or bell of a deer, could be added to the cover layer to enrich the variations of the formed lighting fixtures.

The fibrous layer 4 may enhance these decorative and functional aspects provided by the cover layer 3, or the fibrous layer 4 may provide its own decorative and functional aspects. A means for providing an enhanced appearance comprises the fibrous layer. In certain embodiments, the fibrous layer 4 is placed over an outer surface of the cover layer 3 such that the fibrous layer 4 is an outer layer of the lighting fixture B. The fibrous layer 4 may cover a portion of or the entire cover layer 3.

In embodiments, the fibrous layer 4 comprises a plurality natural or synthetic fiber that alters the outer surface of the cover layer 3. This in turn, in some embodiments, gives the lighting fixture B a contoured outer surface, providing a fur-like appearance, a textured appearance, or a printed or colored appearance. In embodiments, the fibrous layer 4 alters a portion of the light that emits from the light source 2 and passes through the cover layer 3. For example, the fibrous layer 4 may diffuse a portion of the light passing through the cover layer 3. This may create a visual effect for an observer of the lighting fixture B, where a portion of the light diffused by the fibrous layer 4 may appear to be glowing at night.

Figure 4:
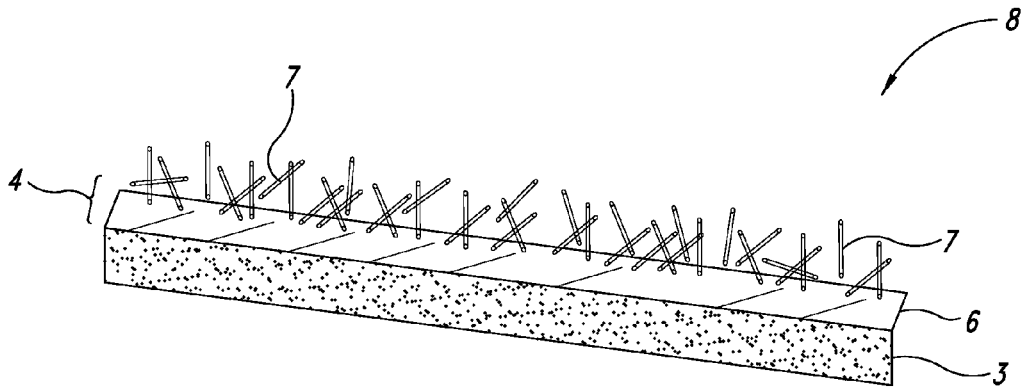
FIG. 4 is a cross-sectional view of a fibrous layer and a substrate.

FIG. 4 depicts an embodiment of the fibrous layer 4 comprising a plurality of elongated natural or synthetic fibers 7 disposed over an adhesive layer 6, where the adhesive layer 6 is disposed over the cover layer 3. In this embodiment, the cover layer 3 acts as a substrate for the fibrous layer 4.

The fibers 7, also referred to as flock in certain embodiments, may be elongated fibers having a length dimension and a width or diameter dimension. In embodiments, individual fibers 7 have a diameter in the range of about a few thousandths of a centimeter (or about 1.7 to 22 dtex) and a length in the range of about 0.25 to 5 millimeters. Other dimensions are possible.

The fibers 7 may be monofilament and may comprise any one or combination of an assortment of materials, including but not limited to natural or synthetic materials, cotton, rayon, acrylic, nylon, polyester, or other types of conductive material (which is desirable for electrostatic flocking described below). The fibers 7 may be cut in random, non-uniform lengths (see fibers 4*b* in FIG. 2) through milling, cutting, tearing or grinding. The fibers 7 may also be precision cut to a specified length (see fibers 4*a* in FIG. 2), or may be a combination of the two cuts (see fibers 4*c* in FIG. 3).

The fibers 7 may be dyed, bleached, chemically treated, or finished before or after they are milled, cut, or otherwise processed. Finishing agents may be chosen to achieve a desired result or characteristic of the fibers 7, such as a luster, increased siftability, antistatic properties, or good conductivity (which is desirable for electrostatic flocking). The fibers 7 may be tumble or cyclone dried prior to applying the fibers 7 to the adhesive layer 6. In embodiments using electrostatic flocking, it is desirable to not completely dry the fibers 7 because moisture content may add to the fibers 7 conductivity. The specific moisture content of the fibers 7 may be controlled by the amount of drying.

In some embodiments, the fibers 7 are configured to provide decorative and functional aspects to the lighting fixture B for a more colorful or attractive scene. For example, in some instances, a dazzling phenomenon is created when light emitted from the light source 2 passes through the cover layer 3 and is diffused by the fibers 7, making the lighting fixture B appear more splendid and elegant, and in some circumstances, appearing to have a glow. In other embodiments, the fibers 7 may be all or partially reflective or may carry glitter, creating a sparkling effect when light is reflected off the fibers 7.

In some embodiments, the fibers 7 are tinted, colored, or patterned. For example, as depicted in FIG. 3, if the fixture B is substantially formed into the shape of a snowman, a section of the fibrous layer 4*c* at the hands of the snowman may be tinted or pattered to appear glove-like, such as with black tint or coloring, or a section of the fibrous layer 4*d* at a nose of the snowman may be tinted or pattered to appear carrot-like, such as with orange tint or coloring. Specific patterns of colors can also be added to the fibrous layer, for example an ornament on a Christmas tree, a Santa Claus costume, or the stripe or bell of a deer, to enrich the variations of the formed lighting fixtures.

In embodiments, the adhesive layer 6 may comprise one or more of many types of adhesives depending on the desired application. For example, an adhesive may be chosen based on desirable characteristics of the fibrous layer 4. The desired characteristics may include solvent resistance, washability, rigidity or flexibility, pigmentation, flame retardance, or other requirements. Examples include an acrylic for lightfast properties (i.e., resistant to fading on exposure to light), PVC for adhesion to vinyl, or urethane for toughness. If electrostatic flocking is used to apply the fibrous layer 4, conductive properties of the adhesive layer 6 should be considered. Moreover, it is desirable that the adhesive layer 6 has a similar flexibility and resistance to wear as its substrate, which in some embodiments is the cover layer 3. Also, in embodiments, the adhesive layer 6 may be colored to substantially match or be color coordinated with the fibers 7 or the cover layer 3.

The adhesive layer 6 may be applied by many different methods. For example, a roller passing over the cover layer 3 may apply the adhesive layer 6. A variety of coating methods may also be used, such as a spraying, brushing, dipping, printing, or any other method that is capable of applying a desired amount and thickness of adhesive layer 6 over the cover layer 3.

Figure 5:
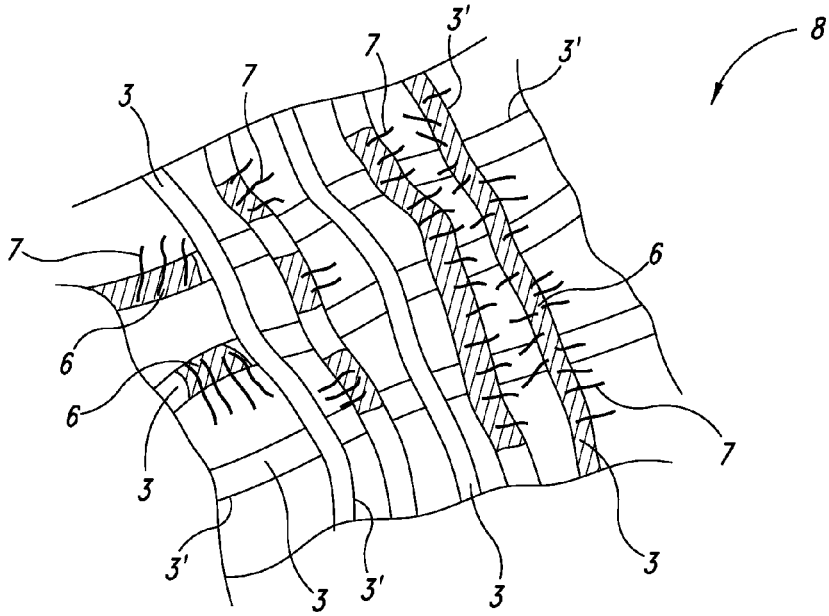
FIG. 5 is a perspective view of a mesh of cover material having portions substantially covered with fibrous material.

In an embodiment, depicted in FIG. 5, a cover layer and fibrous layer combination 8 comprises a cover layer 3 of threads 3' or other textile fibers forming a mesh characterized by a net-like open appearance with open spaces between material of the mesh. The mesh of cover layer 3 may be made from a variety of constructions including woven threads 3', knit, lace, or crochet fabrics or materials. For example, in the embodiment shown in FIG. 5, the mesh of cover layer 3 is woven threads 3' or other woven textile fibers, with certain threads or fibers having elongated fibrous material 7 projecting therefrom of varying or similar lengths. On an upper surface of the cover layer 3 mesh is an adhesive 6 wherein fibrous material 7 is adhered to the cover layer 3. In embodiments, portions of the cover layer 3 are substantially covered with fibrous material 7 while other portions of the cover layer 3 lacks fibrous material 7, and in other embodiments, the cover layer 3 may be pattered or printed with different fibrous material 7. Only placing adhesive 6 in areas of the cover layer 3 where fibrous material 7 is desired may achieve this strategic placement of fibrous material 7 on the cover layer 3. Masking particular areas of the cover layer 3 having adhesive 6 may also allow strategic placement or patterning of fibrous materials 7. Many other configurations and methods or possible.

In certain embodiments, the fibrous layer 4 is formed on portions of the cover layer 3 by flocking. Flocking is a process of applying particles or material to an adhesive coating that is on a surface or substrate. In embodiments, the fibers 7 may be applied to the cover layer 3 in a variety of ways, including mechanical flocking (depicted in FIG. 6), electrostatic flocking (depicted in FIG. 7), or a combination of the two. A means for creating a layer of fibrous material comprises flocking.

Figure 6:
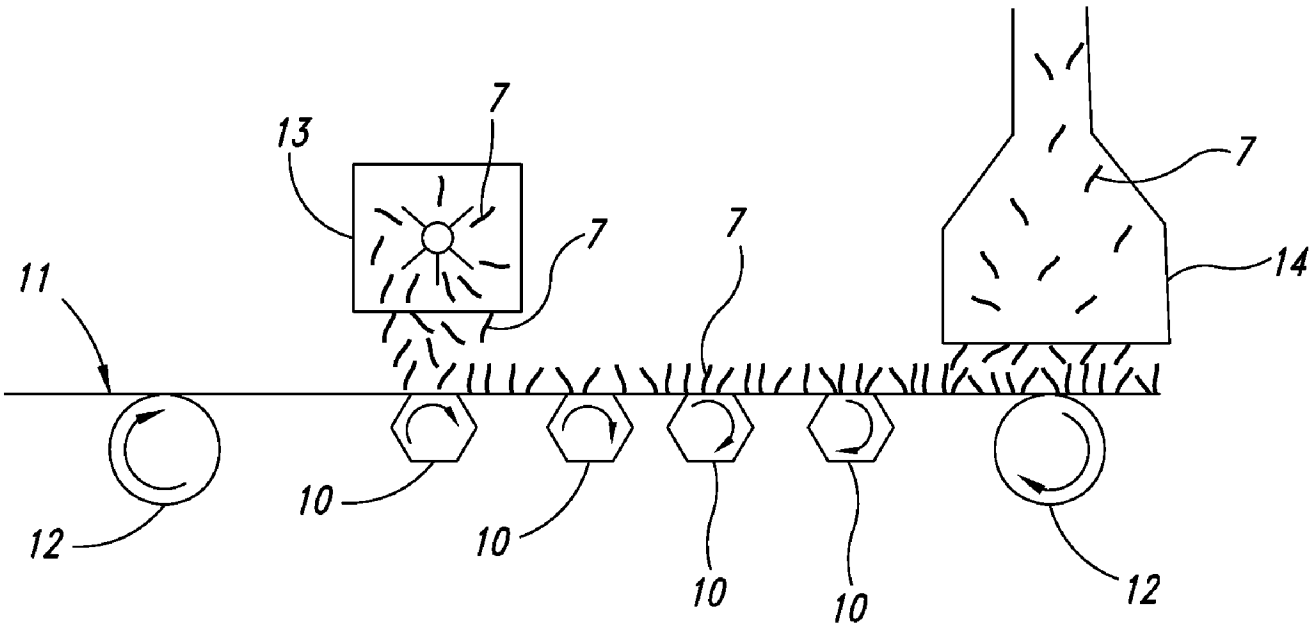
FIG. 6 is a schematic view of a mechanical flocking process.

Mechanical flocking, as depicted in FIG. 6, is typically achieved using a plurality of beater bars 10 to agitate an adhesive coated substrate 11, typically a cover layer, having adhesive on an outer surface (the upper surface in FIG. 6), that is rolled by a conveyer system 12 over a series of the beater bars 10 (or polygonal rollers) to vibrate the adhesive coated substrate 11. A fiber hopper 13 provides fibers 7 onto the adhesive coated substrate 11, and the vibration from the beater bars 10 drives the fibers into the adhesive. Fibers 7 not sufficiently adhered to by the adhesive are then mechanically removed from the adhesive coated substrate 11 after passing by the beater bars 10. These unadhered fibers may be mechanically removed by a vacuum device 14, or may be shook off in other embodiments.

Figure 7:
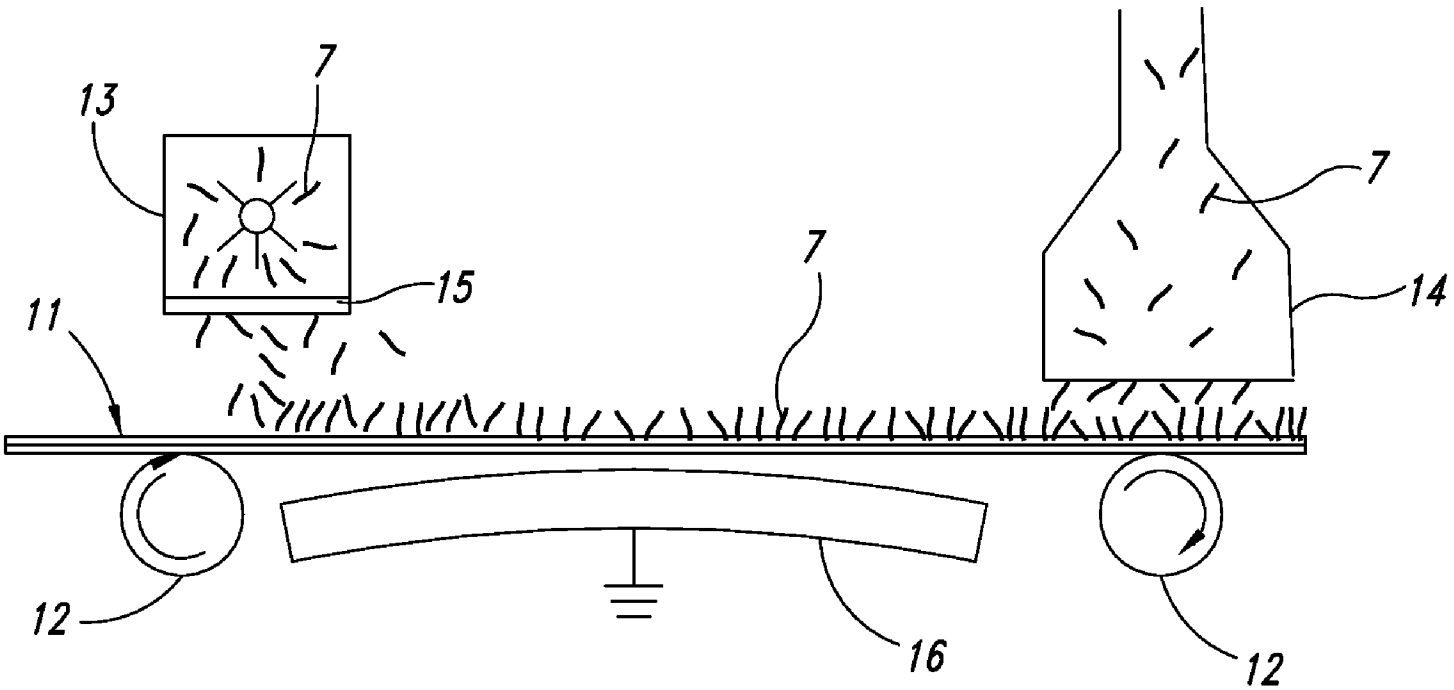
FIG. 7 is a schematic view of an electrostatic flocking process.

Electrostatic flocking, as depicted in FIG. 7, uses an electric field, typically a field of static electricity, to orient fibers in a substantially perpendicular alignment. Embodiments may use alternating current or direct current, and high voltages are typically used. An embodiment may use voltages in the range of about 30,000 to 120,000 volts, and an embodiment using an alternating current may use an operating frequency of about 25 Hz to 60 Hz. Many variables affect the choice of operating voltage or frequency, including the electrostatic and physical properties and dimensions of the fibers 7, the substrate 11, the atmospheric and weather conditions, and other conditions that may affect the ability of the fibers 7 to hold a charge or that may affect the electrostatic field created during the electrostatic flocking process.

In some embodiments using electrostatic flocking, the adhesive coated substrate 11 passes between potentials of an electrostatic field. In one embodiment, the fiber hopper 13 is on one side of the adhesive coated substrate 11, where an electrode 15 in the fiber hopper 13 provides a positive charge to the fibers 7. The electrode 15 in the fiber hopper 13 may be a positive electrode grid. In other embodiments using an alternating current, the fibers 7 may receive an alternating positive and negative charge from the electrode 15 in the fiber hopper 13.

In FIG. 7, the fiber hopper 13 is pictured above the adhesive coated substrate 11. On an opposite side of the adhesive coated substrate 11 is a grounded electrode 16. The charged fibers 7 drop from the fiber hopper 13 and the charged fibers 7 become substantially aligned with an electric field of force formed by the grounded electrode 16 located below the adhesive coated substrate 11. The charged fibers 7 are attracted in the direction of the adhesive due to the electric field of force, where many of the fibers 7 are propelled towards the adhesive coated substrate 11 and become embedded in the adhesive of the adhesive coated substrate 11.

Use of electrostatic flocking typically provides a more uniform and dense fiber layer than mechanical flocking, with most fibers 7 being substantially perpendicular to a surface of the substrate 11 to which the fibers 7 adhere. Increasing or decreasing the electric field may control the speed and thickness of the fiber layer produced by electrostatic flocking. Increasing or decreasing the applied voltage to the grounded electrode 16 or the distance between the grounded electrode 16 and the substrate 11 may control the electric field. Having a controlled environment for electrostatic flocking is also desirable because variations in temperature and relative humidity may affect the electrical sensitivity and conductivity of the fibers and substrate.

Figure 8A:
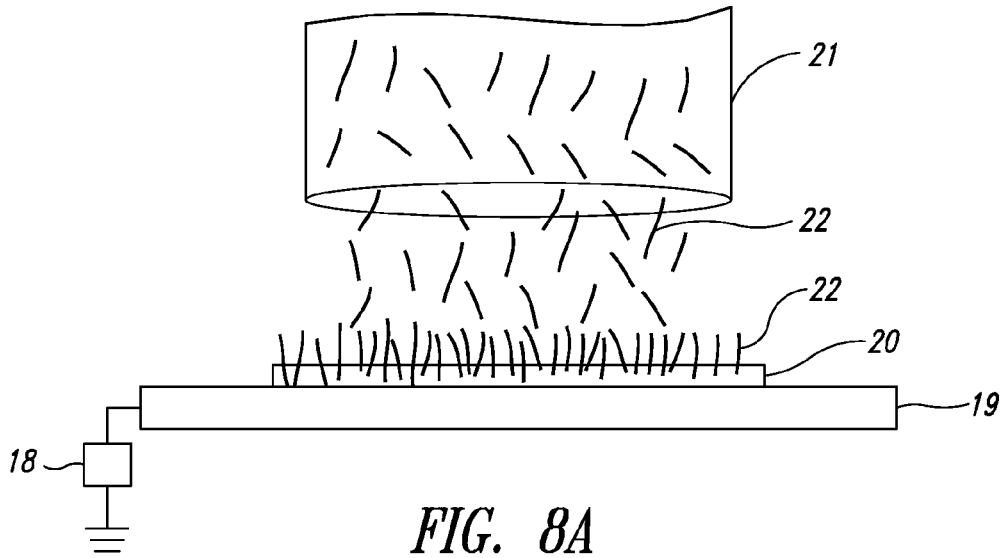
FIG. 8 is a schematic view of embodiments of an electrostatic flocking process.
Figure 8B:
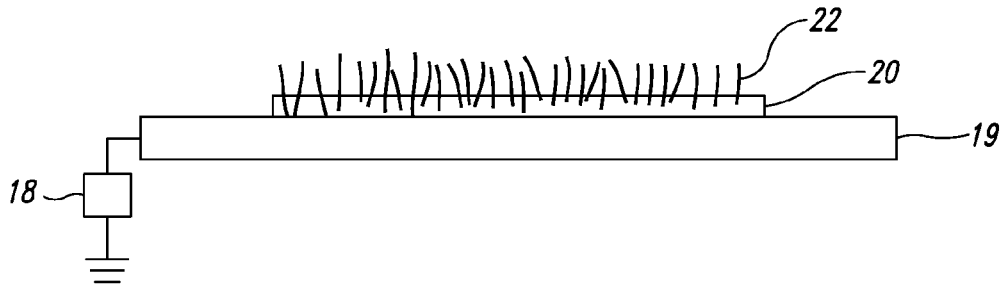

In other embodiments, shown in FIG. 8, an electrode 18 may be coupled to a substrate 19 (often a cover layer) or an adhesive layer 20 or both. The electrode 18 may provide, for example, a negative high direct current voltage and may be configured with a line that carries the high voltage current to the ground after it flows through the substrate 19 or adhesive layer 20. In these embodiments, the adhesive layer 20 is disposed between the substrate 19 and a flock dispenser 21 that provides charged flock 22 to the adhesive layer 20. The adhesive layer 20 may be directly applied to the substrate 19 in many embodiments.

The flock dispenser 21 may be configured to provide a charge to the flock 22 via an electrode that provides a high voltage, for example a positive high direct current voltage. Alternatively, the flock 22 may be provided with a charge through other methods, such as a treatment, finish, or process, prior to the flock being provided to the adhesive layer 20. In some embodiments, where the flock 22 is charged via other methods, the flock dispenser 21 may comprise a human worker dispensing the flock 22 over the adhesive layer 22.

Upon application of the voltage to the electrode 18 (negative for example), an electric field is produced in the substrate 19, adhesive layer 20, or both, wherein lines of electric force of the electric field are oriented or directed towards the substrate 19 or adhesive layer 20. The charged flock 22 (positive for example) in proximity of the electric field are then attracted to the substrate 19 or adhesive layer 20, wherein many of the charged flock 22 become embedded in the adhesive layer 20.

Other flocking methods are available, including use of portable flocking devices; a flock spraying apparatus comprising an air compressor, a reservoir of flock, and a spray gun coupled to the air compressor and the reservoir, wherein the apparatus is configured to spray the flock onto an adhesive coated substrate. A flocking transfer method using transfer may also be used, wherein an adhesive coated substrate is mechanically placed in contact with flock. With the use of any flocking method, excess flock not adhering to the adhesive coated substrate may be mechanically shaken off.

As used herein, the term layer is a term used to help delineate the spatial relationship of one material to another. Accordingly, the term layer does not require the layer to be contiguous, a single thickness, or in a single plane.

From the foregoing, it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A decorative lighting fixture comprising:

a frame having structural elements adapted to form a desired contoured shape;

a light source inside the frame;

a substrate coupled to the frame, wherein the light source is configured to disperse light exiting the frame so that the light is visible to a viewer outside the frame through at least a portion of the substrate; and a plurality of outwardly extending fibrous elements coupled to at least a portion of the substrate such that at least some of the light provided through the substrate can be diffused by the fibrous material.

2. The lighting fixture of claim 1 wherein at least a portion of the fibrous elements are coupled to the substrate by flocking

3. The lighting fixture of claim 2 wherein the flocking of the fibrous elements comprise electrostatic flocking

4. The lighting fixture of claim 3 wherein at least a portion of the fibrous elements comprise a conductive material.

5. The lighting fixture of claim 4 wherein at least a portion of the conductive material comprises cotton, rayon, acrylic, nylon, or polyester.

6. The lighting fixture of claim 1 wherein at least a portion of the fibrous elements are milled, cut, torn, or grinded.

7. The lighting fixture of claim 1 wherein at least a portion of the fibrous elements are treated, finished or processed to have a desired characteristic.

8. The lighting fixture of claim 7 wherein the desired characteristic comprises conductivity.

9. The lighting fixture of claim 1, wherein the desired characteristic comprises a color, tint or shade.

10. The lighting fixture of claim 1 wherein the substrate comprises a mesh having portions of material and open spaces, wherein at least a portion of the fibrous elements are coupled to a material portion of the mesh.

11. The lighting fixture of claim 10 wherein at least some of the light provided through the substrate passes through an open space of the mesh.

12. The lighting fixture of claim 1 wherein at least a portion of the fibrous material is configured to provide a fur-like appearance.

13. The lighting fixture of claim 1 wherein the substrate comprises a light-refracting material.

14. The lighting fixture of claim 1 wherein the fibrous elements do not cover the entire substrate.

15. The lighting fixture of claim 1 wherein a first portion of the fibrous elements comprise a first color and the first portion of the fibrous elements is coupled to a first portion of the substrate, and wherein the fibrous elements comprise a second color and the second portion of the fibrous elements is coupled to a second portion of the substrate.

16. The lighting fixture of claim 1 wherein the structural elements comprise rod sections and rib sections.

17. The lighting fixture of claim 16 wherein at least a portion of the structural elements are a plurality of rods and ribs molded and coupled together to create the desired shape.

18. The lighting fixture of claim 1 wherein the light source comprises a plurality of light bulbs attached directly to the frame.

19. The lighting fixture of claim 1 wherein the desired shape is an animal.

20. The lighting fixture of claim 1 wherein the desired shape is a plant.

21. A method of manufacturing a light fixture comprising:

providing a frame having structural elements adapted to form a desired contoured shape;

providing a light source;

providing a substrate coupled to the frame, wherein the light source is configured to disperse light inside the frame so that the light is visible to a viewer through at least a portion of the substrate; and providing a plurality of outwardly extending fibrous elements coupled to at least a portion of the substrate such that at least some of the light provided through the substrate can be diffused by the fibrous material.

* * * * *